US010840044B2

(12) United States Patent
Graskowski et al.

(10) Patent No.: US 10,840,044 B2
(45) Date of Patent: Nov. 17, 2020

(54) CERAMIC INSULATOR FOR VACUUM INTERRUPTERS

(71) Applicant: SIEMENS AKTIENGESELLSCHAFT, Munich (DE)

(72) Inventors: Frank Graskowski, Wandlitz (DE); Angelika Hartmann, Weisendorf (DE); Sylvio Kosse, Erlangen (DE); Andreas Lawall, Berlin (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 16/324,640

(22) PCT Filed: Jul. 13, 2017

(86) PCT No.: PCT/EP2017/067652
§ 371 (c)(1),
(2) Date: Feb. 11, 2019

(87) PCT Pub. No.: WO2018/028918
PCT Pub. Date: Feb. 15, 2018

(65) Prior Publication Data

US 2019/0172667 A1 Jun. 6, 2019

(30) Foreign Application Priority Data

Aug. 9, 2016 (DE) ..... 10 2016 214 755

(51) Int. Cl.
*H01H 33/662* (2006.01)

(52) U.S. Cl.
CPC *H01H 33/66261* (2013.01); *H01H 33/66207* (2013.01); *H01H 2033/66276* (2013.01); *H01H 2033/66292* (2013.01)

(58) Field of Classification Search
CPC ..... H01H 33/66207; H01H 33/66261; H01H 2033/66276; H01H 2033/66284; H01H 2033/66292; H02B 17/36; H02B 17/42
(Continued)

(56) References Cited

U.S. PATENT DOCUMENTS 3,178,541 A 4/1965 Jennings
4,267,415 A * 5/1981 Holmes ..... H01H 33/66261 218/139
(Continued)

FOREIGN PATENT DOCUMENTS

CN 103632882 A 3/2014
CN 204497139 U 7/2015
(Continued)

OTHER PUBLICATIONS

Translation of JP2010073460 (Original doc. published Apr. 2, 2010) (Year: 2010).*
(Continued)

*Primary Examiner* — William A Bolton
(74) *Attorney, Agent, or Firm* — Laurence Greenberg; Werner Stemer; Ralph Locher

(57) ABSTRACT

A ceramic insulator for vacuum interrupters extends along a longitudinal extent and forms a cavity in said longitudinal extent. The cavity has a first opening on a first end of the longitudinal extent and a second opening on a second end of the longitudinal extent. The openings are designed so that they can be sealed in a gas-tight manner using appropriate connections. The sealed first opening is designed to guide at least one fixed contact into the cavity, and the sealed second opening is designed to guide at least one moving contact into the cavity. The ceramic insulator has, on an inner face of the cavity, one or multiple electrically conductive discharge path
(Continued)

interrupters extending perpendicularly to the longitudinal extent of the ceramic insulator.

17 Claims, 4 Drawing Sheets

(58) Field of Classification Search
USPC ..... 218/136, 134, 139, 148, 118
See application file for complete search history.

(56) References Cited

U.S. PATENT DOCUMENTS 4,618,749 A * 10/1986 Bohme ..... H01H 33/66207 218/134
4,737,605 A * 4/1988 Bettge ..... H01H 33/6645 218/136
7,758,917 B2 7/2010 Gentsch et al.
7,939,777 B2 5/2011 Dullni et al.
8,698,034 B2 * 4/2014 Ryu ..... H01H 33/66261 218/134
8,847,097 B2 * 9/2014 Renz ..... H01H 33/66261 218/136
2014/0251958 A1 9/2014 Wang et al.

FOREIGN PATENT DOCUMENTS

DE 19503347 A1 8/1996
DE 102005043484 B4 9/2007
DE 102007022875 A1 11/2008
JP 2010073460 A 4/2010
JP 2012230876 A 11/2012
WO 2006032522 A1 3/2006
WO 2012065842 A1 5/2012

OTHER PUBLICATIONS

Translation of DE102007022875 (Original doc. published Nov. 27, 2008) (Year: 2008).*

* cited by examiner

CERAMIC INSULATOR FOR VACUUM INTERRUPTERS

BACKGROUND OF THE INVENTION

Field of the Invention

The invention relates to a ceramic insulator for vacuum interrupters, to a vacuum interrupter having a corresponding ceramic insulator, and to a method for manufacturing a ceramic insulator.

Vacuum interrupters are known from the prior art which, as an insulator, comprise a ceramic tube, the ends of which are closed in a vacuum-tight manner, and at the ends of which respectively either a moving contact or a fixed contact is inserted into the vacuum tube from the exterior.

However, the technical usefulness of these ceramics is limited on the grounds of discharge build-up along the insulators, particularly on the vacuum side. Discharge build-up in a vacuum is dictated by the desorption of adsorbed gas layers by field-emitted electrons. The voltage withstand (breakdown field strength) along the surface is thus not scaled linearly to the insulator length D, but is only proportional to $D^{-0.5}$.

As a result, particularly at high and very high voltages, particularly in excess of 100 kV, it becomes increasingly difficult to achieve the requisite voltage withstand, for example in vacuum interrupters.

Given that, in one-piece insulators, the breakdown field strength declines as the length increases, the lengthening of individual insulators does not deliver the objective of a high voltage withstand, of the type which needs to be achieved for example for lightning impulse voltages, e.g. of 650 kV, with acceptable levels of cost and technical complexity.

In addition to the high cost of individual long insulators and the limited voltage withstand, the magnitude of the mass of the moving contact which is to be moved in long vacuum interrupters and a correspondingly high drive energy required are also negative factors.

In the prior art, this issue is resolved by segmented insulating bodies, in which shorter insulators are respectively connected by metal structures, which project into the vacuum region, thereby interrupting the discharge paths. Discharge build-up is prevented accordingly. As a result of the higher number of connection points and individual ceramic components, the costs associated with such tubes are relatively high.

SUMMARY OF THE INVENTION

The object of the invention is then the provision of a ceramic insulator for vacuum tubes, which can be produced more cost-effectively and which eliminates the disadvantages of the prior art.

This object is fulfilled by the invention of the independent claims, and by the claims which are dependent upon said claims.

A ceramic insulator for vacuum interrupters according to the invention is formed by a ceramic insulator extending along a longitudinal extent and forming a cavity in said longitudinal extent. The cavity comprises a first opening on a first side of the longitudinal extent, and a second opening on a second side of the longitudinal extent. The first opening and the second opening are suitable for being sealed in a gas-tight manner using appropriate connecting means. The sealed first opening is suitable for guiding at least one fixed contact into the cavity, and the sealed second opening is suitable for guiding at least one moving contact into the cavity. The ceramic insulator further comprises, on the inner face of the cavity, one or more electrically conductive discharge path interrupters, extending perpendicularly to the longitudinal extent of the ceramic insulator. It is advantageous if the electrically conductive discharge path interrupters, perpendicularly to the longitudinal extent of the ceramic insulator, form a closed path, i.e. a closed structure, particularly an annular structure.

The appropriate connecting means for the gas-tight closure of the ceramic insulator are extensively known from the prior art, and are also described, for example, as bushings. Particularly, bellows-type or corrugated bushings for the vacuum-tight accommodation of moving contacts in a vacuum are known.

The ceramic of the ceramic insulator is preferably configured as a one-piece component.

In a further two-part or multi-part form of embodiment, additionally to the electrically conductive discharge path interrupter(s), metal shields and/or metal structures can also be provided, of the type which are known from the prior art.

For the substantial enhancement of voltage withstand, it is thus also possible to employ multi-part ceramic insulators, which are interrupted by metal structures, and to combine the latter with electrically conductive discharge path interrupters.

A ceramic insulator is also preferred in which the one or more electrically conductive discharge path interrupters are formed from a metal and/or a metal-metal oxide mixture (also known as "cermet") and/or a semiconductor, which shall also be understood to include electrically conductive semi-metallic compounds, such as metal oxides, metal carbides, metal nitrides or metal borides.

It is also preferred that the ceramic insulator has a cylindrical shape, particularly a hollow cylindrical shape.

It is also preferred that the one or more electrically conductive discharge path interrupters are formed by means of a metal-plating method, by sputtering or vapor deposition. Other methods from the prior art are also appropriate including, for example, chemical deposition from the liquid or gaseous phase, cold gas or plasma spraying, or thick-film methods such as dip coating, adhesive bonding or printing, with the subsequent burn-in of appropriate substances. It is further preferred that the one or more electrically conductive discharge path interrupters are additionally provided with an additional further metal plating, such that the material properties are enhanced, particularly with respect to electrical and mechanical properties.

It is also preferred that the additional further metal plating is generated by galvanic methods and/or by sputtering and/or by vapor deposition.

It is also preferred that, in the cavity of the ceramic insulator, one or more metal platings are arranged, extending perpendicularly to the longitudinal extent, i.e. in the circumferential direction of the ceramic insulator, upon which the one or more electrically conductive discharge path interrupters are secured.

It is further preferred that the one or more electrically conductive discharge path interrupters have an annular and/or convex structure.

It is also preferred that the clearance between the plurality of electrically conductive discharge path interrupters lies between 5 mm and 50 mm, preferably between 10 mm and 20 mm.

It is also preferred that the plurality of electrically conductive discharge path interrupters have a mutual clearance, and the extent of the electrically conductive discharge path interrupters, in the direction of the longitudinal extent, is 5% to 30% of the clearance between the discharge path interrupters in the direction of the longitudinal extent. It is also further preferred that the extent of the electrically conductive discharge path interrupters, in the direction of the longitudinal extent, is 5% to 30%, preferably 10% to 20% of the clearance between the discharge path interrupters in the direction of the longitudinal extent.

It is also preferred that the ceramic insulator, on the outer side, i.e. the side which is not arranged in the vacuum, also comprises one or more electrically conductive discharge path interrupters, extending perpendicularly to the longitudinal extent of the ceramic insulator. It is particularly preferred that the electrically conductive discharge path interrupters located on the outer side possess some or all of the above-mentioned properties of the electrically conductive discharge path interrupters which are arranged in the cavity.

A vacuum interrupter having a ceramic insulator according to the preceding embodiments is also preferred.

A method for producing a ceramic insulator for vacuum interrupters is also preferred, wherein the ceramic insulator comprises a base element extending along a longitudinal extent, and forming a cavity 15 in said longitudinal extent. The cavity 15, on a first side of the longitudinal extent, comprises a first opening and, on a second side of the longitudinal extent, comprises a second opening, which are suitable for being sealed in a gas-tight manner by appropriate connecting means. The sealed first opening is suitable for guiding at least one fixed contact into the cavity, and the second sealed opening is suitable for guiding at least one moving contact into the cavity. On the inner side of the cavity of the ceramic insulator, one or more metallic structures, extending perpendicularly to the longitudinal extent of the ceramic insulator, are formed by means of sputtering and/or vapor deposition or comparable appropriate methods, and these structures either function directly as electrically conductive discharge path interrupters, or electrically conductive discharge path interrupters are applied to said structures. The connecting means are also described as bushings. For the moving contact, bellows-type or corrugated bushings are particularly, but not exclusively, considered.

It is further preferred that the electrically conductive discharge path interrupters are formed by means of galvanic methods and/or chemical deposition methods and/or mechanical methods such as printing, dip coating and/or sputtering and/or vapor deposition on the structures, and/or metallic elements, preferably metallic annular elements, are secured as electrically conductive discharge path interrupters to the structures by soldering.

The invention is described hereinafter with reference to the figures.

DESCRIPTION OF THE INVENTION

Figure 1:
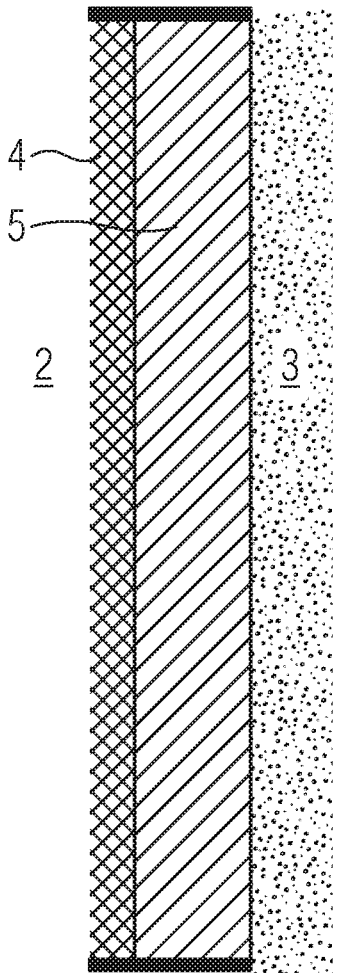
FIG. 1: shows a schematic representation of a one-piece long insulator having a low electric withstand.

FIG. 1 shows a schematic and exemplary representation of a long, one-piece insulator 5 of a vacuum tube, having a vacuum side 2 and a gas side or outer side 3. At high voltages, a breakdown path 4 is formed along the surface of the insulator 5 on the vacuum side 2.

This breakdown path is dictated in a vacuum by the desorption of adsorbed gas layers by field-emitted electrons.

Figure 2:
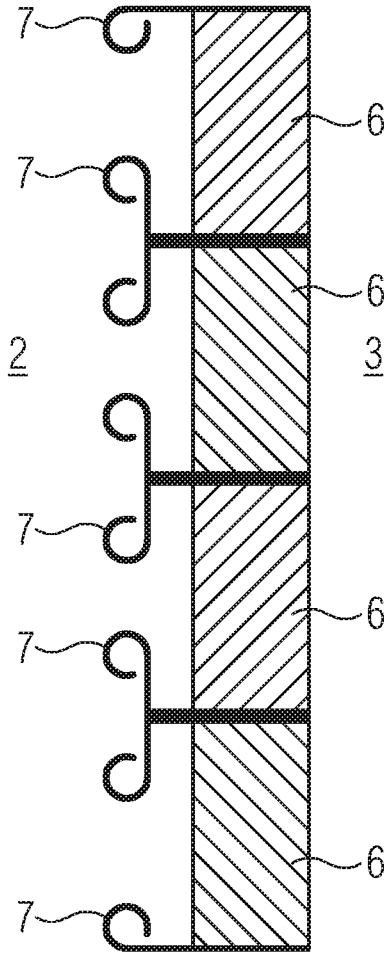
FIG. 2: shows a schematic representation of a multi-part insulator from the prior art for the interruption of flashovers along the surface of the insulator.

FIG. 2 shows a multi-part insulator 6, wherein the individual insulator segments of the insulator 6 are interrupted by metallic field control elements 7, and the metallic field control elements, at least on the vacuum side 2, project into the vacuum, thereby ensuring an interruption of the breakdown path.

Figure 3:
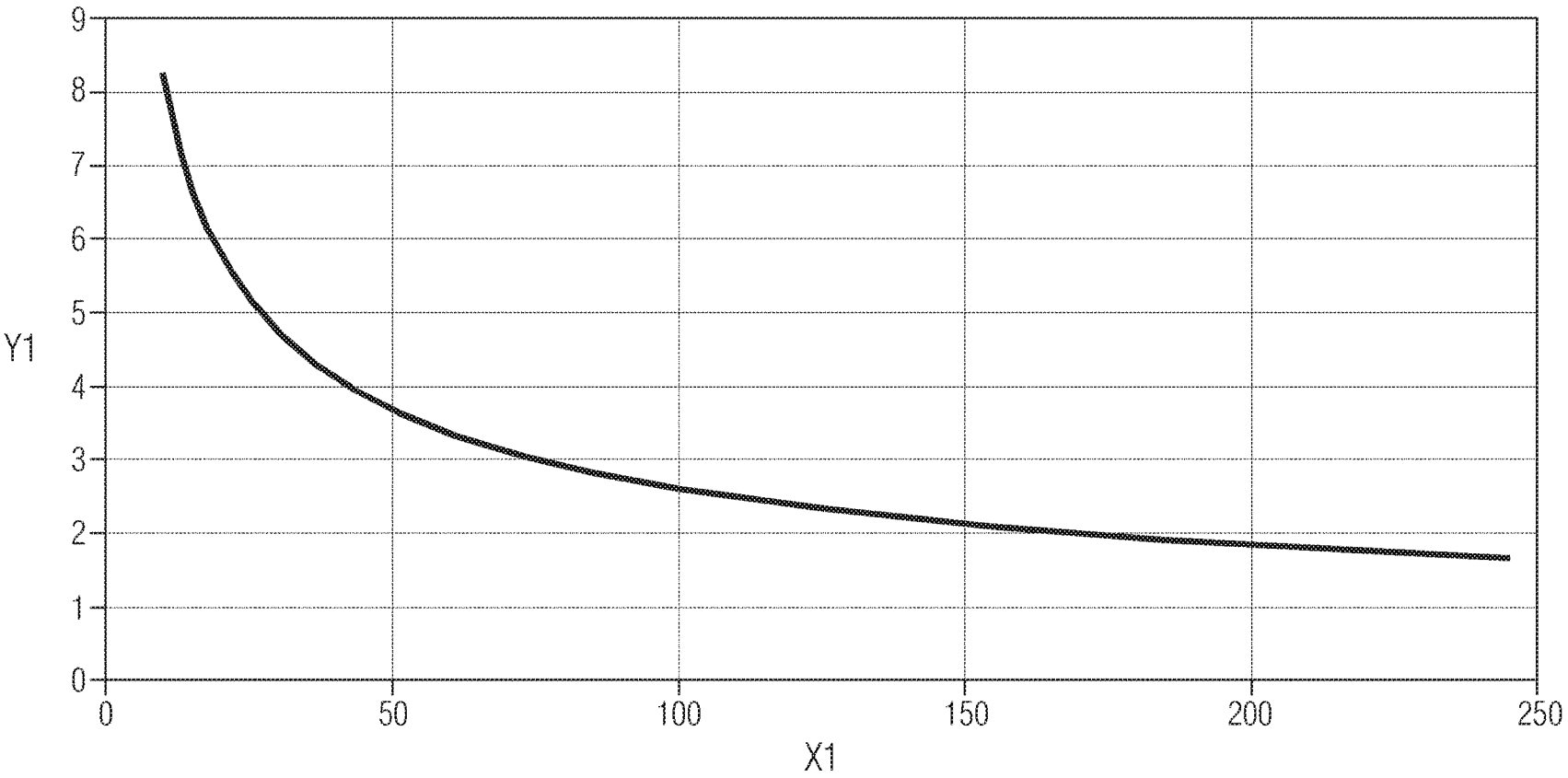
FIG. 3: shows a graphic representation of the number of the insulator segments plotted against the segment length of the insulator segments, for a lightning impulse voltage of 390 kV.

FIG. 3 shows a graphic representation of the total number of insulator segments Y1 plotted against the segment length of the insulator segments X1 in mm for the insulation of lightning impulse voltages of 390 kV. The minimum requisite number of the ceramic insulator segments for the insulation of lighting impulse voltages of 390 kV is thus represented as a function of segment length. For a solution involving a one-piece ceramic, a length of approximately 700 mm is thus required.

Figure 4:
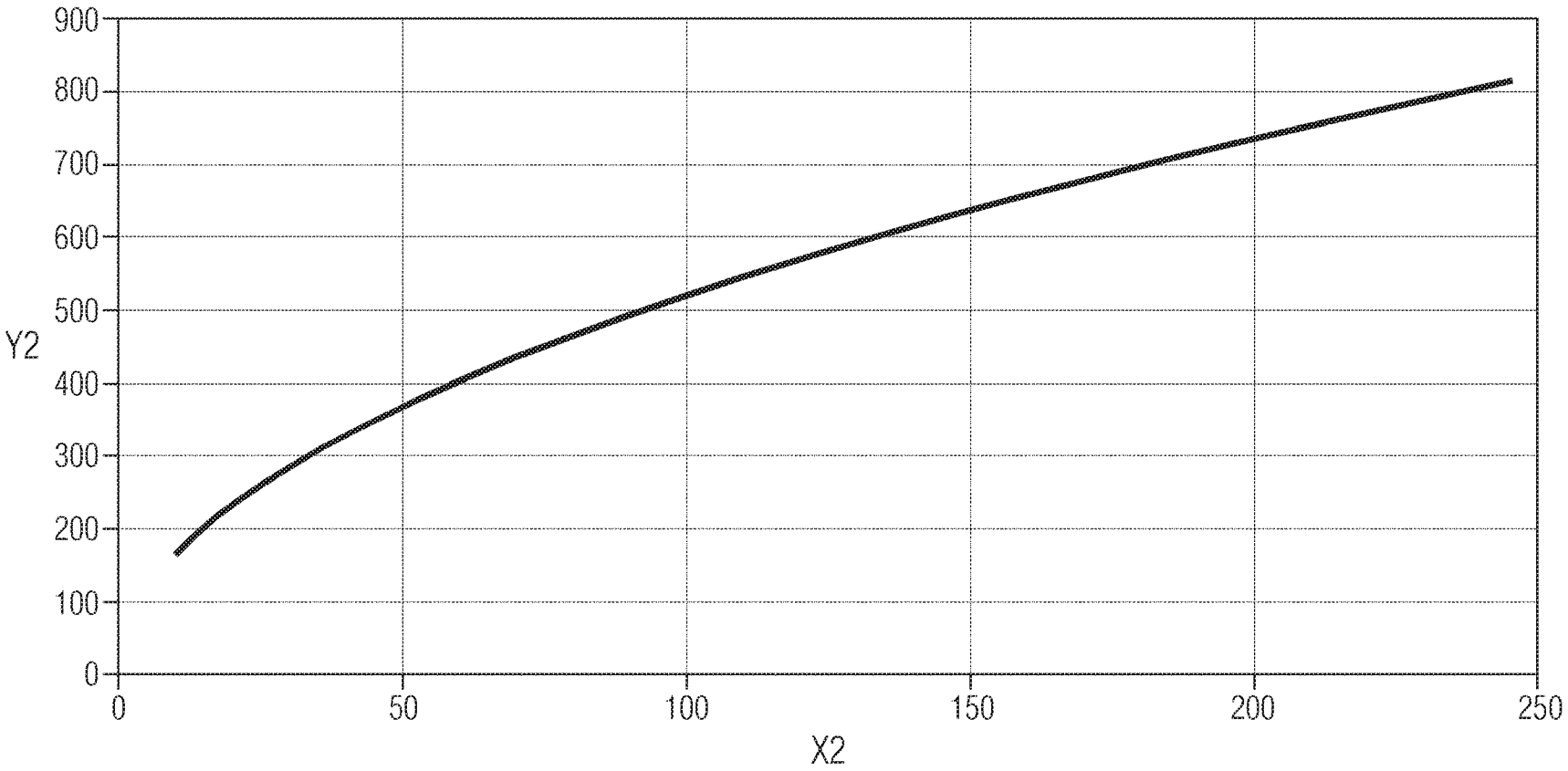
FIG. 4: shows a graphic representation of the overall insulator length plotted against the length of the insulator segments, for a lightning impulse load of 650 kV.

FIG. 4 shows a graphic representation of the overall insulator length Y2 in mm plotted against the segment length of the insulators X2 in mm, for a lightning impulse load of 650 kV. The total insulator length of an insulator arrangement for lightning impulse loads of 650 kV is thus represented as a function of the length of the individual segments. For short insulator segments of e.g. 30 mm in length, total insulator lengths of less than 300 mm are thus possible.

Figure 5:
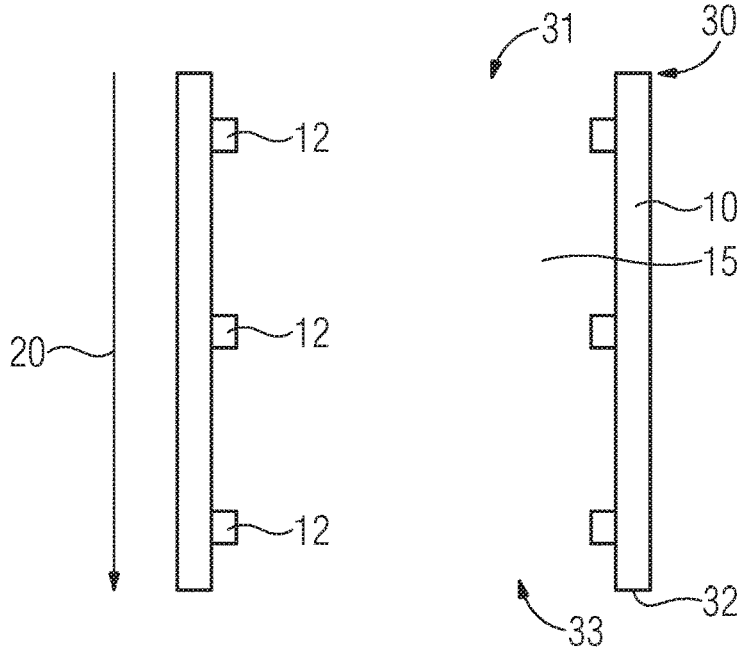
FIG. 5: shows a schematic representation of a ceramic insulator according to the invention, having electrically conductive discharge path interrupters.

FIG. 5 shows a ceramic insulator 10 according to the invention, having a longitudinal extent 20 and a cavity 15 located in the ceramic insulator. The ceramic insulator comprises discharge path interrupters 12. On a first side 30 of the longitudinal extent 20, a first opening 31 is arranged and, on a second side 32 of the longitudinal extent 20, a second opening 33 is arranged.

Figure 6:
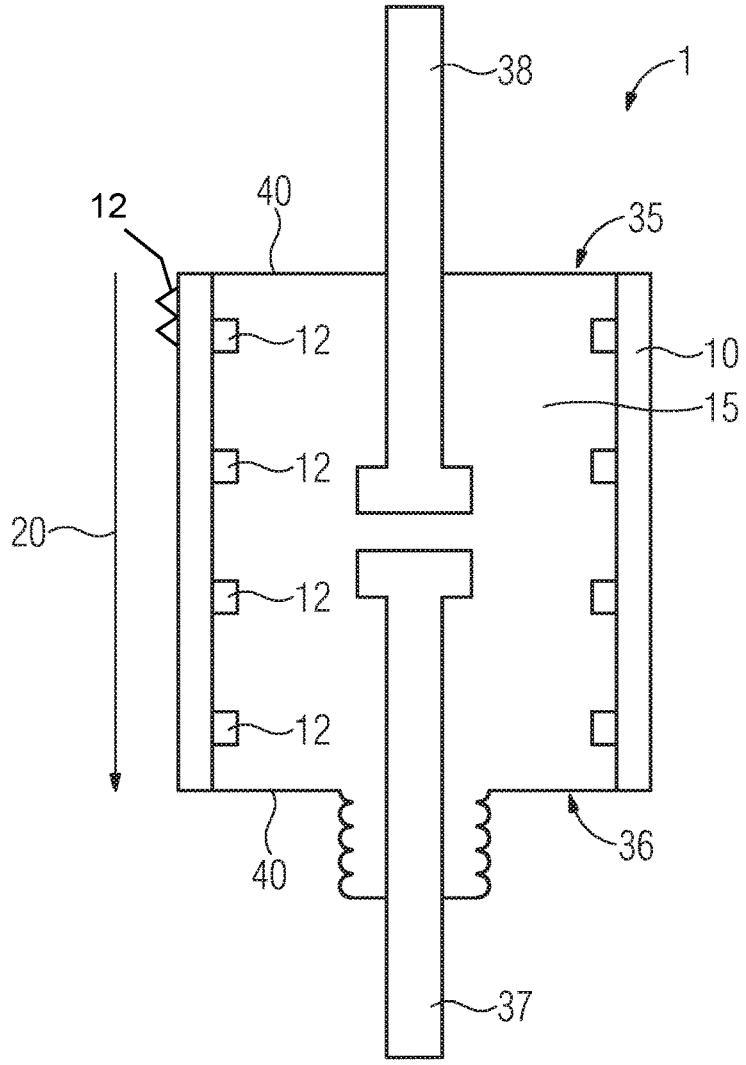
FIG. 6: shows a vacuum interrupter having a ceramic insulator according to the invention, with electrically conductive discharge path interrupters.

FIG. 6 shows a vacuum interrupter 1 according to the invention, having a fixed contact 38 which extends through a connecting means 40 through the sealed first opening 35. The moving contact 37 of the vacuum interrupter 1 is also represented, which extends through an appropriate connecting means 40—in this case, a bellows-type or corrugated bushing is represented—through the second sealed opening 36. The vacuum interrupter 1 further comprises a ceramic insulator 10 according to the invention, having discharge path interrupters 12. The fixed contact 38 and the moving contact 37 extend along the longitudinal extent 20.

The invention claimed is:

1. A ceramic insulator for vacuum interrupters, the ceramic insulator comprising:

a base body extending along a longitudinal extent and forming a cavity in the longitudinal extent;

said cavity having a first opening on a first side of the longitudinal extent, and a second opening on a second side of the longitudinal extent;

connectors sealing said first and second openings in a gas-tight manner to form a sealed first opening and a sealed second opening;

said first sealed opening being configured for guiding at least one fixed contact into said cavity, and said sealed second opening being configured for guiding at least one moving contact into said cavity; and one or more electrically conductive discharge path interrupters disposed on an inner face of said cavity, said one or more electrically conductive discharge path interrupters extending perpendicularly to the longitudinal extent of said base body, said one or more electrically conductive discharge path interrupters having an annular and/or convex structure, said one or more electrically conductive discharge path interrupters being a plurality of electrically conductive discharge path interrupters disposed with a clearance of between 5 mm and 50 mm therebetween.

2. The ceramic insulator according to claim 1, wherein a ceramic of said base body is a one-piece component.

3. The ceramic insulator according to claim 1, wherein said one or more electrically conductive discharge path interrupters are formed from at least one material selected from the group consisting of a metal, a cermet and a semiconductor.

4. The ceramic insulator according to claim 1, wherein said base body has a cylindrical shape.

5. The ceramic insulator according to claim 1, wherein said one or more electrically conductive discharge path interrupters have characteristics of having been formed by a method selected from the group consisting of a metal-plating method, a spraying method, a chemical deposition method, a printing method, a sputtering deposition method and a vapor deposition method.

6. The ceramic insulator according to claim 5, wherein said one or more electrically conductive discharge path interrupters are additionally provided with a further metal plating.

7. The ceramic insulator according to claim 6, wherein said further metal plating is a metal plating generated by a method selected from the group consisting of a galvanic methods, a chemical deposition method, a printing method, sputtering and vapor deposition.

8. The ceramic insulator according to claim 1, which comprises one or more metal platings arranged in said cavity of said base body, said one or more metal platings extending perpendicularly to the longitudinal extent of said base body and having said one or more electrically conductive discharge path interrupters formed or secured thereon.

9. The ceramic insulator according to claim 1, wherein said clearance is between 10 mm and 20 mm.

10. The ceramic insulator according to claim 1, wherein said base body has an exterior carrying one or more electrically conductive discharge path interrupters, extending perpendicularly to the longitudinal extent of said base body.

11. A vacuum interrupter, comprising the ceramic insulator according to claim 1.

12. A ceramic insulator for vacuum interrupters, the ceramic insulator comprising:

a base body extending along a longitudinal extent and forming a cavity in the longitudinal extent;

said cavity having a first opening on a first side of the longitudinal extent, and a second opening on a second side of the longitudinal extent;

connectors sealing said first and second openings in a gas-tight manner to form a sealed first opening and a sealed second opening;

said first sealed opening being configured for guiding at least one fixed contact into said cavity, and said sealed second opening being configured for guiding at least one moving contact into said cavity; and one or more electrically conductive discharge path interrupters disposed on an inner face of said cavity, said one or more electrically conductive discharge path interrupters extending perpendicularly to the longitudinal extent of said base body, said one or more electrically conductive discharge path interrupters having an annular and/or convex structure, said one or more electrically conductive discharge path interrupters being a plurality of electrically conductive discharge path interrupters disposed with a mutual clearance, and an extent of said electrically conductive discharge path interrupters, in a direction of the longitudinal extent, being 5% to 30% of the clearance between said discharge path interrupters in the direction of the longitudinal extent.

13. The ceramic insulator according to claim 12, wherein the extent of said electrically conductive discharge path interrupters is 10% to 20% of the mutual clearance between said discharge path interrupters.

14. A method of producing a ceramic insulator for a vacuum interrupter, the ceramic insulator having a base body extending along a longitudinal extent and forming a cavity in the longitudinal extent;

the cavity being formed with a first opening on a first side of the longitudinal extent and with a second opening on a second side of the longitudinal extent;

the first and second openings being sealed in a gas-tight manner by appropriate connecting devices, and wherein the sealed first opening is configured for guiding at least one fixed contact into the cavity, and the sealed second opening is configured for guiding at least one moving contact into the cavity;

the method comprising:

forming on an inner side of the cavity of the ceramic insulator, one or more electrically conductive structures, extending perpendicularly to the longitudinal extent of the ceramic insulator, the one or more electrically conductive structures having an annular and/or convex structure, the electrically conductive structures being formed by a method selected from the group consisting of sputtering, vapor deposition, spraying, chemical deposition and printing; and thereby forming the electrically conductive structures to either function directly as electrically conductive discharge path interrupters, or to support the electrically conductive discharge path interrupters applied to the structures, the electrically conductive discharge path interrupters disposed with a clearance of between 5 mm and 50 mm therebetween.

15. The method according to claim 14, which comprises forming the electrically conductive discharge path interrupters by one or more methods selected from the group consisting of galvanic methods, sputtering, vapor deposition, spraying methods, chemical deposition methods and printing methods applied to the structures.

16. The method according to claim 14, which comprises forming the electrically conductive discharge path interrupters by securing metallic elements as electrically conductive discharge path interrupters to the structures by soldering.

17. The method according to claim 14, which comprises securing metallic annular elements to the structures.

* * * * *